US008893587B2

(12) United States Patent
Lai

(10) Patent No.: US 8,893,587 B2
(45) Date of Patent: Nov. 25, 2014

(54) WRENCH DEVICE

(76) Inventor: Jim Lai, Changhua (TW)

( * ) Notice: Subject to any disclaimer, the term of this patent is extended or adjusted under 35 U.S.C. 154(b) by 0 days.

(21) Appl. No.: 13/818,653

(22) PCT Filed: Feb. 25, 2011

(86) PCT No.: PCT/CN2011/071300
§ 371 (c)(1),
(2), (4) Date: Jun. 13, 2014

(87) PCT Pub. No.: WO2012/113151
PCT Pub. Date: Aug. 30, 2012

(65) Prior Publication Data

US 2014/0290443 A1 Oct. 2, 2014

(51) Int. Cl.
*B25B 13/00* (2006.01)
*B25B 13/10* (2006.01)

(52) U.S. Cl.
CPC ..... *B25B 13/10* (2013.01)
USPC ..... 81/58; 81/127; 81/126

(58) Field of Classification Search
USPC ..... 81/126–129, 134, 90.1, 90.3, 150, 151, 81/58, 58.2, 92, 94, 97
See application file for complete search history.

(56) References Cited

U.S. PATENT DOCUMENTS

| | | | | | |
|---|---|---|---|---|---|
| 1,657,902 | A * | 1/1928 | Ross | ..... | 81/126 |
| 1,758,013 | A * | 5/1930 | Schubert et al. | ..... | 81/127 |
| 3,101,018 | A * | 8/1963 | Andersen | ..... | 81/127 |
| 3,878,741 | A * | 4/1975 | Wilson | ..... | 81/128 |
| 6,145,415 | A * | 11/2000 | Liu | ..... | 81/143 |
| 8,733,214 | B2 * | 5/2014 | Hsu | ..... | 81/126 |

* cited by examiner

*Primary Examiner* — Monica Carter
*Assistant Examiner* — Melanie Alexander

(57) ABSTRACT

A wrench device includes a handle bar having a driving head, the driving head having a connection base, the connection base having a guiding wall, a pivoting jaw having a first receiving groove which corresponding to the connection base, the pivoting jaw having a sliding groove opened through the first receiving groove, a sliding jaw having a sliding portion which is movable relative to the sliding groove, a driving opening being formed between the pivoting jaw and the sliding jaw, the sliding jaw having a pushing portion which corresponding to the guiding wall. Under this arrangement, when the handle bar is rotated clockwise, the pivoting jaw is abutted against the upper portion of the driving head, so that the pivoting jaw and the sliding jaw is fixed relative to the connection base; thereby, the driving opening is attached to an object so as to lock or unlock the object.

7 Claims, 5 Drawing Sheets

WRENCH DEVICE

CROSS-REFERENCE TO RELATED APPLICATION

This application is a National Stage entry of International Application No. PCT/CN2011/071300, filed on Feb. 25, 2011, under the International Convention.

BACKGROUND OF THE INVENTION

1. Field of the Invention

The present invention relates to a hand tool, and more particularly to a wrench device wherein a user can operate the wrench device repeatedly.

2. Description of Related Art

Wrench, one of the most common hand tools used frequently in daily life, is applied so as to lock or unlock an object (such as a nut, a bolt, or an oil pipe) via a rotating manner.

The prototype of a wrench has a handle portion and a driving portion definitely, so that a user holds the handle portion with the driving portion sleeving onto the object for locking or unlocking the object from a substance. Wrenches are further divided into two categories, unadjustable wrenches and adjustable wrenches. The driving opening of a conventional adjustable wrench is adjustable so as to meet and receive the objects with different sizes.

However, no matter the unadjustable wrenches or the adjustable wrenches, the user needs to detach the conventional wrench from the object when the object has been rotated to a certain extent, therefore, the user operates the conventional wrench inconveniently and inefficiently.

The present invention has arisen to mitigate and/or obviate the disadvantages of the conventional.

SUMMARY OF THE INVENTION

The main objective of the present invention is to provide a wrench device.

To achieve the objective, a wrench device comprises a handle bar, a pivoting jaw and a sliding jaw, the handle bar having a driving head defined at one end thereof, the driving head having a connection base defined at one end thereof, the connection base having a guiding wall defined at one side thereof, the pivoting jaw being L-shaped and having a first receiving groove recessed inwardly at a bending portion of the outer periphery thereof, the first receiving groove corresponding to the connection base, an interval distance for rotating the pivoting jaw relative to the connection base being limited by the bottom face of the first receiving groove, the pivoting jaw having a sliding groove opened through the first receiving groove, the sliding jaw having a sliding portion defined thereon, the sliding portion moving relative to the sliding groove, a driving opening being formed between the pivoting jaw and the sliding jaw, the sliding jaw having a pushing portion defined at one end thereof, the pushing portion corresponding to the guiding wall. Wherein, the connection base has a pivoting hole opened therethrough; the first receiving groove has a via hole opened at each sidewall thereof; a pivoting shaft passes through the via hole and the pivoting hole, so that the pivoting jaw pivots relative to the connection base; the driving head has a baffle arm extended outwardly at another end thereof; the bottom portion of the cross sectional area of the sliding groove is circled; a width of an upper portion of the cross sectional area of the sliding groove is smaller than another width of a bottom portion of the cross sectional area of the sliding groove; the shape of the cross section of the sliding portion of the sliding jaw corresponds to the shape of the cross section of the sliding groove; the pivoting jaw has a through hole opened at a bottom therethrough; the through hole communicates with the sliding groove; a rod member is inserted into the through hole; the sliding jaw has a second receiving groove opened at another end thereof; the opening of the second receiving groove communicates with the through hole; a top portion of the rod member is slidably assembled into the second receiving groove; the second receiving groove has a spring defined therein; two ends of the spring elastically abut against the rod member and one end of the second receiving groove respectively; one end of the second receiving groove is adjacent to the pushing portion; wherein when the sliding portion of the sliding jaw slightly moves opposite to the pivoting jaw in the sliding groove, the rod member compresses the spring, so that the sliding jaw moves resiliently because of the abutting of the spring which is contributed by the elastic force of the spring; meanwhile, the pivoting jaw moves resiliently; a breach is defined on the sliding jaw and located above the pushing portion for receiving the upper portion of the guiding wall; the upper portion of the pushing portion is higher than the upper portion of the guiding wall. Under this arrangement, when the handle bar is rotated clockwise, the pivoting jaw is abutted against the upper portion of the driving head, so that the pivoting jaw and the sliding jaw is fixed relative to the connection base; thereby, the driving opening is attached to an object so as to lock or unlock the object; on the contrary, when the handle bar is rotated counterclockwise, the pivoting jaw is not abutted against the upper portion of the driving head, so that the pivoting jaw and the sliding jaw rotate relative to the connection base; thereby, the guiding wall abuts against the pushing portion, so that the sliding portion of the sliding jaw slightly moves opposite to the pivoting jaw in the sliding groove so as to enlarge the width of the driving opening; in addition, the enlarged width equals to the size of said interval distance for rotating the pivoting jaw relative to the connection base, and the enlarged width is larger than the width of the object; therefore, the object does not rotate with the rotation of the driving opening.

Further benefits and advantages of the present invention will become apparent after a careful reading of the detailed description with appropriate reference to the accompanying drawings.

DETAILED DESCRIPTION OF THE INVENTION

Figure 1:
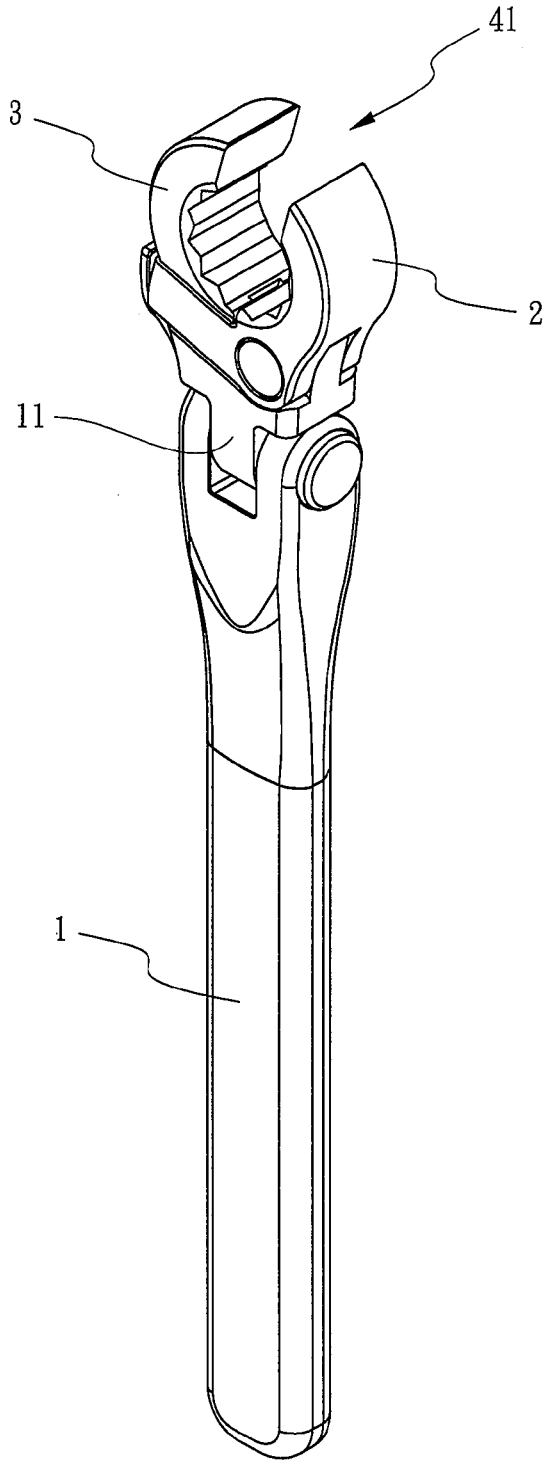
FIG. 1 is a perspective view of a wrench device of the present invention.
Figure 2:
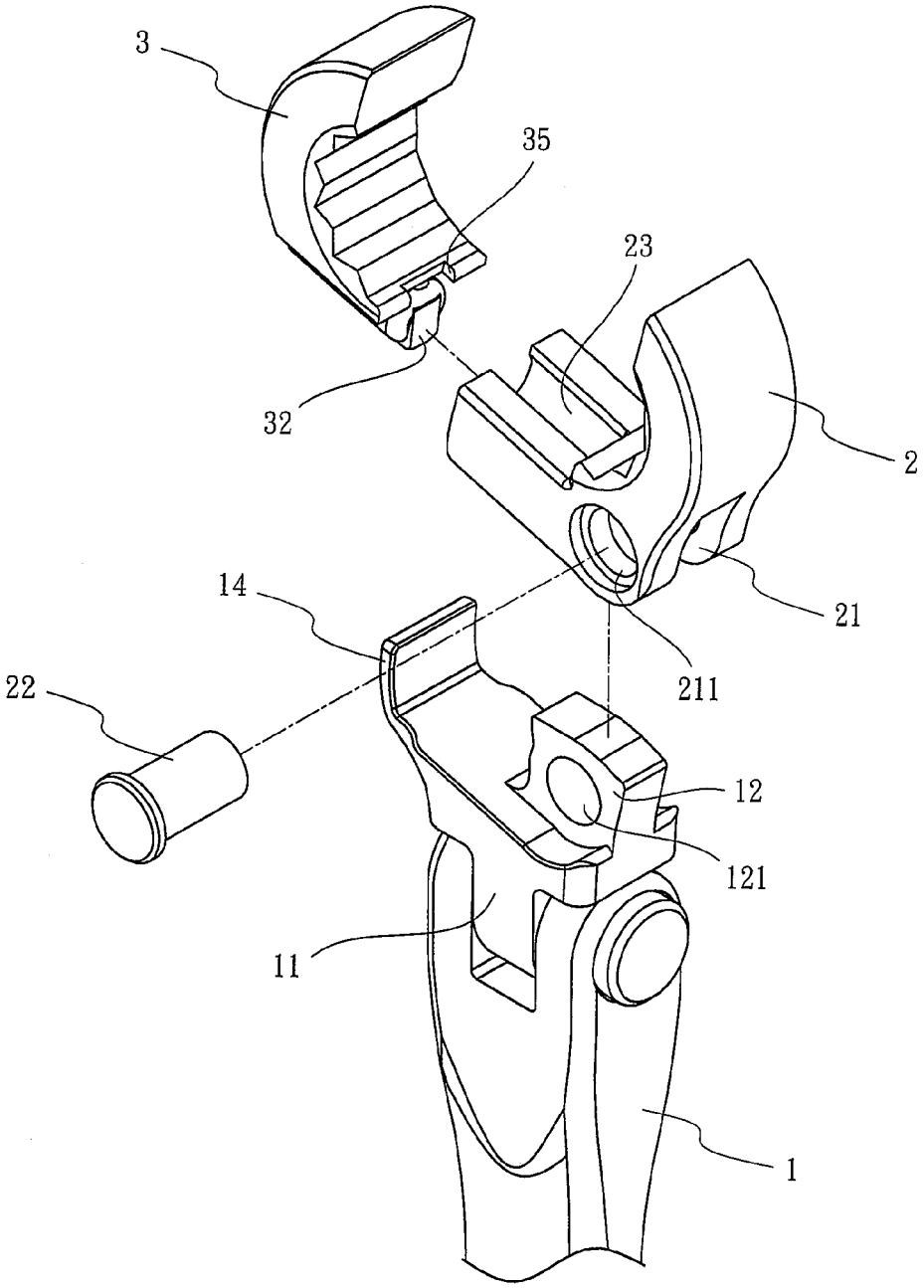
FIG. 2 is an exploded view of the wrench device.
Figure 3:
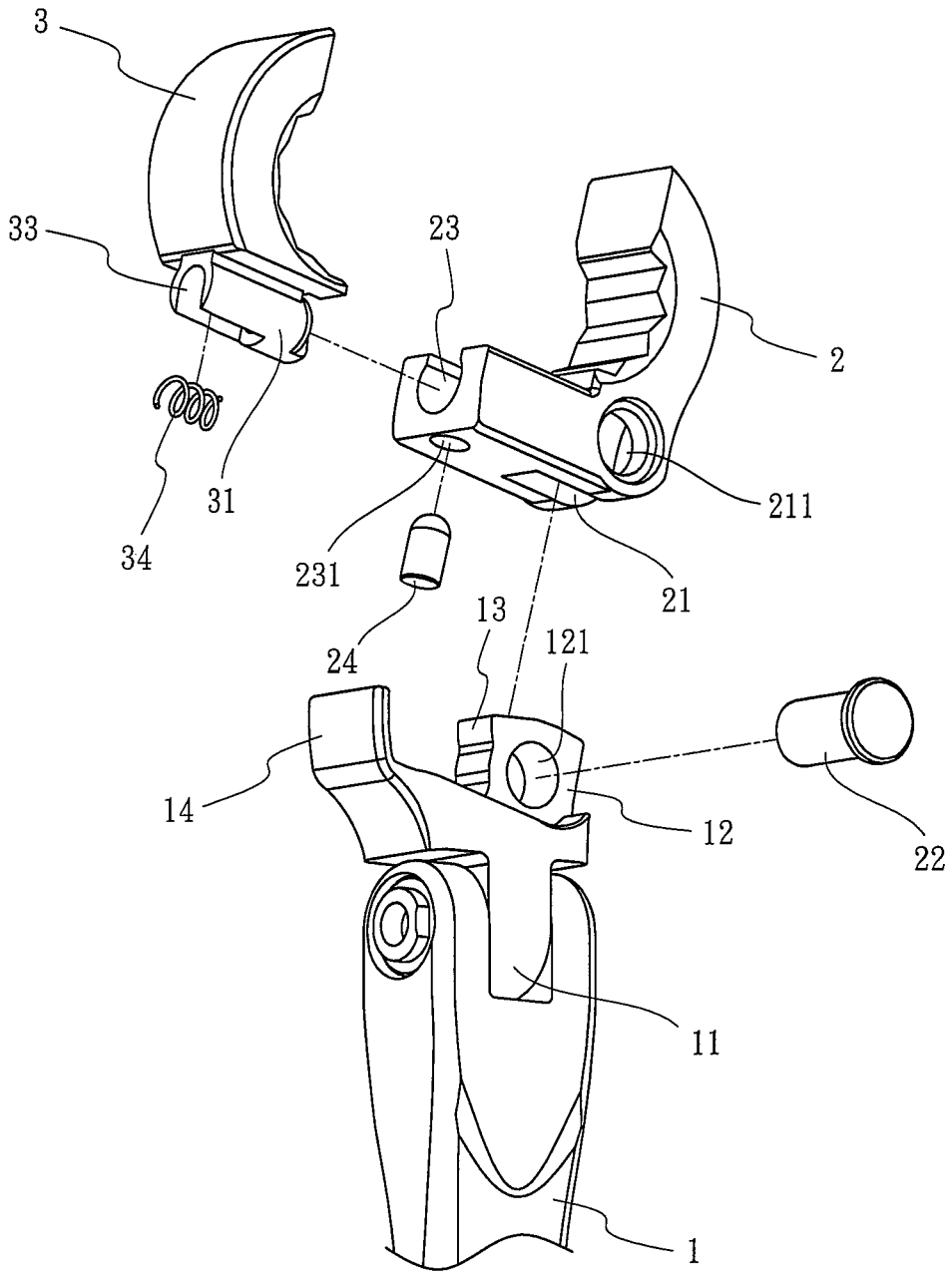
FIG. 3 is another exploded view of the wrench device.

Referring to FIGS. 1-5, a wrench device in accordance with the present invention comprises a handle bar 1, a pivoting jaw 2 and a sliding jaw 3.

The handle bar 1 has a driving head 11 defined at one end thereof. In this embodiment, the driving head 11 is rotatable relative to the handle bar 1; however, in other embodiments, the driving head 11 can be fixed with one end of the handle bar 1. The driving head 11 has a connection base 12 defined at one end thereof. The connection base 12 has a pivoting hole 121 opened therethrough. The connection base 12 has a guiding wall 13 defined at one side thereof. The driving head 11 has a baffle arm 14 extended outwardly at another end thereof. The baffle arm 14 forms as a plate structure.

The pivoting jaw 2 is L-shaped and having a first receiving groove 21 recessed inwardly at a bending portion of the outer periphery thereof. The first receiving groove 21 corresponds to the connection base 12. An interval distance for rotating the pivoting jaw 2 relative to the connection base 12 is limited by the bottom face of the first receiving groove 21. The first receiving groove 21 has a via hole 211 opened at each sidewall thereof. A pivoting shaft 22 passes through the via hole 211 and the pivoting hole 121, so that the pivoting jaw 2 pivots relative to the connection base 12. The pivoting jaw 2 has a sliding groove 23 opened through the first receiving groove 21. The sliding groove 23 is defined toward to the baffle arm 14. The bottom portion of the cross sectional area of the sliding groove 23 is circled. A width of an upper portion of the cross sectional area of the sliding groove 23 is smaller than another width of a bottom portion of the cross sectional area of the sliding groove 23. The pivoting jaw 2 has a through hole 231 opened at a bottom therethrough. The through hole 231 communicates with the sliding groove 23. A rod member 24 is inserted into the through hole 231. An upper portion of the rod member 24 is inserted into the sliding groove 23.

The sliding jaw 3 has a sliding portion 31 defined at a bottom thereof. The sliding portion 31 moves relative to the sliding groove 23. The shape of the cross section of the sliding portion 31 of the sliding jaw 3 corresponds to the shape of the cross section of the sliding groove 23. A driving opening 41 is formed between the pivoting jaw 2 and the sliding jaw 3. The sliding jaw 3 has a pushing portion 32 defined at one end thereof. The pushing portion 32 corresponds to the guiding wall 13, so that the pushing portion 32 and the guiding wall 13 abut against each other. The sliding jaw 3 has a second receiving groove 33 opened at another end thereof. The opening of the second receiving groove 33 communicates with the through hole 231. A top portion of the rod member 24 is slidably assembled into the second receiving groove 33. The second receiving groove 33 has a spring 34 defined therein. Two ends of the spring 34 elastically abut against the rod member 24 and one end of the second receiving groove 33 respectively, wherein one end of the second receiving groove 33 is adjacent to the pushing portion 32. A breach 35 is defined on the sliding jaw 3 and located above the pushing portion 32 for receiving the upper portion of the guiding wall 13.

Figure 4:
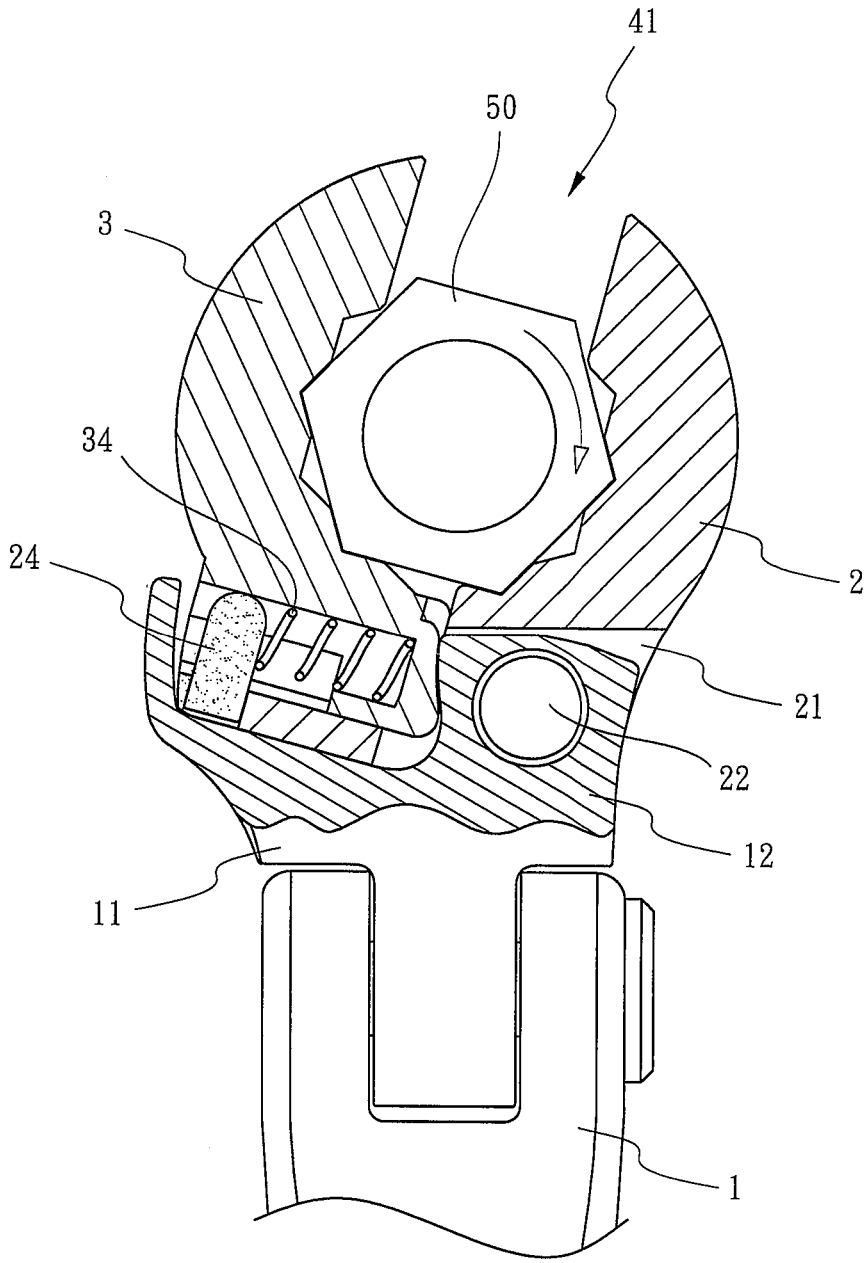
FIG. 4 is a schematic view for showing the wrench device is clockwise rotated by a user, so that the user locks a nut with the wrench device.
Figure 5:
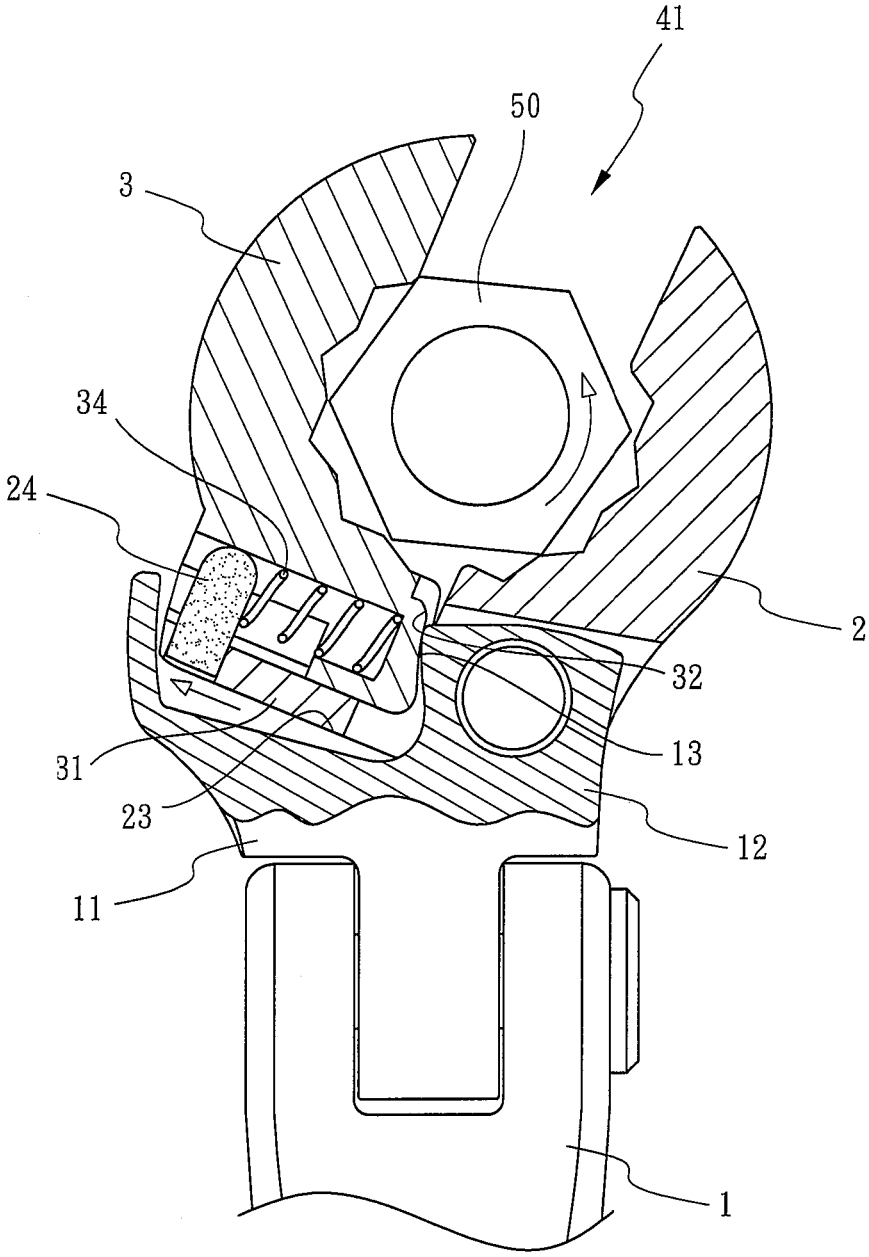
FIG. 5 is a schematic view for showing the wrench device is counterclockwise rotated by the user, so that the user unlocks the nut with the wrench device.

Referring to FIGS. 4-5, when the handle bar 1 is rotated clockwise (a rotating direction from the connection base 12 to the handle bar 1, as shown in FIG. 4), the pivoting jaw 2 is abutted against the upper portion of the driving head 11, so that the pivoting jaw 2 and the sliding jaw 3 is fixed relative to the connection base 12; thereby, the driving opening 41 is attached to an object 50 so as to lock or unlock the object 50 (In this embodiment, the object 50 is a nut; the type of the object 50 is not limited by the present invention.).

When the handle bar 1 is rotated counterclockwise (a rotating direction from the handle bar 1 to the connection base 12, as shown in FIG. 5), the pivoting jaw 2 is not abutted against the upper portion of the driving head 11, so that the pivoting jaw 2 and the sliding jaw 3 rotate relative to the connection base 12; thereby, the guiding wall 13 abuts against the pushing portion 32, so that the sliding portion 31 of the sliding jaw 3 slightly moves opposite to the pivoting jaw 2 in the sliding groove 23 so as to enlarge the width of the driving opening 41; in addition, the enlarged width equals to the size of said interval distance for rotating the pivoting jaw 2 relative to the connection base 12, and the enlarged width is larger than the width of the object 50; therefore, the object 50 does not rotate with the rotation of the driving opening 41, so that a user operates the present invention repeatedly and efficiently so as to improve the working efficiency.

When the sliding portion 31 of the sliding jaw 3 slightly moves opposite to the pivoting jaw 2 in the sliding groove 23, the rod member 24 compresses the spring 34, so that the sliding jaw 3 moves resiliently because of the abutting of the spring 34 which is contributed by the elastic force of the spring 34; meanwhile, the pivoting jaw 2 moves resiliently.

Furthermore, because the upper portion of the pushing portion 32 is higher than the upper portion of the guiding wall 13, the guiding wall 13 guides and abuts the pushing portion 32 of the sliding jaw 3 smoothly, so that the guiding wall 13 abuts against the sliding jaw 3 for smoothly sliding relative to the pivoting jaw 2.

Although the invention has been explained in relation to its preferred embodiment, it is to be understood that many other possible modifications and variations can be made without departing from the spirit and scope of the invention as hereinafter claimed.

What is claimed is:

1. A wrench device comprising:

a handle bar, a pivoting jaw and a sliding jaw;

the handle bar having a driving head defined at one end thereof, the driving head having a connection base defined at one end thereof, the connection base having a guiding wall defined at one side thereof;

the pivoting jaw being L-shaped and having a first receiving groove recessed inwardly at a bending portion of the outer periphery thereof, the first receiving groove corresponding to the connection base, an interval distance for rotating the pivoting jaw relative to the connection base being limited by the bottom face of the first receiving groove, the pivoting jaw having a sliding groove opened through the first receiving groove; and the sliding jaw having a sliding portion defined thereon, the sliding portion moving relative to the sliding groove, a driving opening being formed between the pivoting jaw and the sliding jaw, the sliding jaw having a pushing portion defined at one end thereof, the pushing portion corresponding to the guiding wall;

wherein when the handle bar is rotated clockwise, the pivoting jaw is abutted against the upper portion of the driving head, so that the pivoting jaw and the sliding jaw is fixed relative to the connection base; thereby, the driving opening is attached to an object so as to lock or unlock the object; on the contrary, when the handle bar is rotated counterclockwise, the pivoting jaw is not abutted against the upper portion of the driving head, so that the pivoting jaw and the sliding jaw rotate relative to the connection base; thereby, the guiding wall abuts against the pushing portion, so that the sliding portion of the sliding jaw slightly moves opposite to the pivoting jaw in the sliding groove so as to enlarge the width of the driving opening; in addition, the enlarged width equals to the size of said interval distance for rotating the pivoting jaw relative to the connection base, and the enlarged width is larger than the width of the object; therefore, the object does not rotate with the rotation of the driving opening.

2. The wrench device as claimed in claim 1, wherein the connection base has a pivoting hole opened therethrough; the first receiving groove has a via hole opened at each sidewall thereof; a pivoting shaft passes through the via hole and the pivoting hole, so that the pivoting jaw pivots relative to the connection base.

3. The wrench device as claimed in claim 1, wherein the driving head has a baffle arm extended outwardly at another end thereof.

4. The wrench device as claimed in claim 1, wherein the bottom portion of the cross sectional area of the sliding groove is circled; a width of an upper portion of the cross sectional area of the sliding groove is smaller than another width of a bottom portion of the cross sectional area of the sliding groove; the shape of the cross section of the sliding portion of the sliding jaw corresponds to the shape of the cross section of the sliding groove.

5. The wrench device as claimed in claim 1, wherein the pivoting jaw has a through hole opened at a bottom therethrough; the through hole communicates with the sliding groove; a rod member is inserted into the through hole; the sliding jaw has a second receiving groove opened at another end thereof; the opening of the second receiving groove communicates with the through hole; a top portion of the rod member is slidably assembled into the second receiving groove; the second receiving groove has a spring defined therein; two ends of the spring elastically abut against the rod member and one end of the second receiving groove respectively; one end of the second receiving groove is adjacent to the pushing portion; wherein when the sliding portion of the sliding jaw slightly moves opposite to the pivoting jaw in the sliding groove, the rod member compresses the spring, so that the sliding jaw moves resiliently because of the abutting of the spring which is contributed by the elastic force of the spring; meanwhile, the pivoting jaw moves resiliently.

6. The wrench device as claimed in claim 1, wherein a breach is defined on the sliding jaw and located above the pushing portion for receiving the upper portion of the guiding wall.

7. The wrench device as claimed in claim 1, wherein the upper portion of the pushing portion is higher than the upper portion of the guiding wall.

* * * * *